US005249530A

United States Patent [19]

Wike

[11] Patent Number: 5,249,530

[45] Date of Patent: Oct. 5, 1993

[54] FORCED STEERING RAILROAD TRUCK SYSTEM WITH CENTRAL TRANSVERSE PIVOTED SHAFT

[75] Inventor: Paul S. Wike, Los Gatos, Calif.

[73] Assignee: Westinghouse Electric Corp., Pittsburgh, Pa.

[21] Appl. No.: 888,732

[22] Filed: May 26, 1992

[51] Int. Cl.[5] ..... B61F 5/44; B61F 5/26

[52] U.S. Cl. ..... 105/168; 105/218.2

[58] Field of Search ..... 105/167, 168, 199.1, 105/218.1, 218.2

[56] References Cited

U.S. PATENT DOCUMENTS

| | | | |
|---|---|---|---|
| 64,640 | 5/1867 | DeHuff | 105/169 |
| 128,898 | 7/1872 | Olney | 105/169 |
| 424,089 | 3/1890 | Bosdevex | 105/168 |
| 496,712 | 5/1893 | Warenskjold et al. | 280/102 |
| 916,556 | 3/1909 | Howard | 105/202 |
| 983,478 | 2/1911 | Clark | 105/167 |
| 1,008,921 | 11/1911 | Komarek | 105/202 |
| 1,091,431 | 3/1914 | Halsey | 105/165 |
| 1,822,895 | 9/1931 | Kiesel, Jr. | 105/167 |
| 2,651,526 | 9/1953 | Eubanks | 280/33.55 |
| 2,673,091 | 3/1954 | Planalp | 280/103 |
| 2,746,399 | 5/1956 | Tomás | 105/4 |
| 2,812,725 | 11/1957 | Candlin, Jr. et al. | 105/4 |
| 3,338,183 | 9/1967 | Boissier | 105/202 |
| 3,528,374 | 9/1970 | Wickens | 105/182 |
| 3,570,409 | 3/1971 | Oelkers | 105/182 |
| 3,661,097 | 5/1972 | Jackson | 105/199 R |
| 3,789,770 | 5/1974 | List | 105/168 |
| 3,862,606 | 1/1975 | Scales | 105/167 |
| 3,915,095 | 10/1975 | Briggs | 105/202 |
| 4,082,043 | 4/1978 | Hammonds et al. | 105/182 R |
| 4,111,131 | 9/1978 | Bullock | 105/224.1 |
| 4,133,268 | 1/1979 | Guillaumin | 105/202 |
| 4,162,653 | 7/1979 | Wickens | 105/166 |
| 4,167,906 | 9/1979 | Steinmann et al. | 105/168 |
| 4,170,179 | 10/1979 | Vogel | 105/168 |
| 4,228,740 | 10/1980 | Vogel | 105/168 |
| 4,295,428 | 10/1981 | Dickhart, III et al. | 105/168 |
| 4,413,569 | 11/1983 | Mulcahy | 105/168 |
| 4,458,604 | 7/1984 | Cope | 105/168 |
| 4,480,553 | 11/1984 | Scheffel | 105/167 |
| 4,483,253 | 11/1984 | List | 105/167 |
| 4,485,743 | 12/1984 | Roush et al. | 105/176 |
| 4,625,653 | 12/1986 | Jackson | 105/168 |
| 4,648,326 | 3/1987 | Jackson | 105/168 |
| 4,660,476 | 4/1987 | Franz | 105/168 |
| 4,676,172 | 6/1987 | Bullock | 105/168 |
| 4,742,779 | 5/1988 | Bevand | 105/218.1 X |
| 4,781,124 | 11/1988 | List | 105/168 |
| 4,901,649 | 2/1990 | Fehrenbach et al. | 105/183 |
| 4,903,613 | 2/1990 | Lang et al. | 105/167 |
| 5,131,332 | 7/1992 | Smith | 105/168 X |
| 5,174,218 | 12/1992 | List | 105/167 |

FOREIGN PATENT DOCUMENTS

| | | | |
|---|---|---|---|
| 365489 | 4/1990 | European Pat. Off. | 105/168 |
| 387744 | 9/1990 | European Pat. Off. | 105/168 |
| 2828421 | 6/1978 | Fed. Rep. of Germany . | |

*Primary Examiner*—Robert J. Oberleitner
*Assistant Examiner*—S. Joseph Morano
*Attorney, Agent, or Firm*—D. Schron

[57] ABSTRACT

In a railroad truck, a forced steering system is disclosed for achieving optimal or near optimal wheel set alignment on both straight and curved track sections. Over- and under-steer on curves is minimized and oscillations are minimized or eliminated for trucks transiting straight track sections. A rigid frame and a suspension arrangement, both of which may be used in cooperation with the forced steering system, are disclosed. The forced steering system directs a force, related to the relative orientation between the car body and the truck, to the wheel suspension system thereby altering the wheel set geometry in an optimal manner for both straight and curved track performance.

27 Claims, 6 Drawing Sheets

FIG. 4
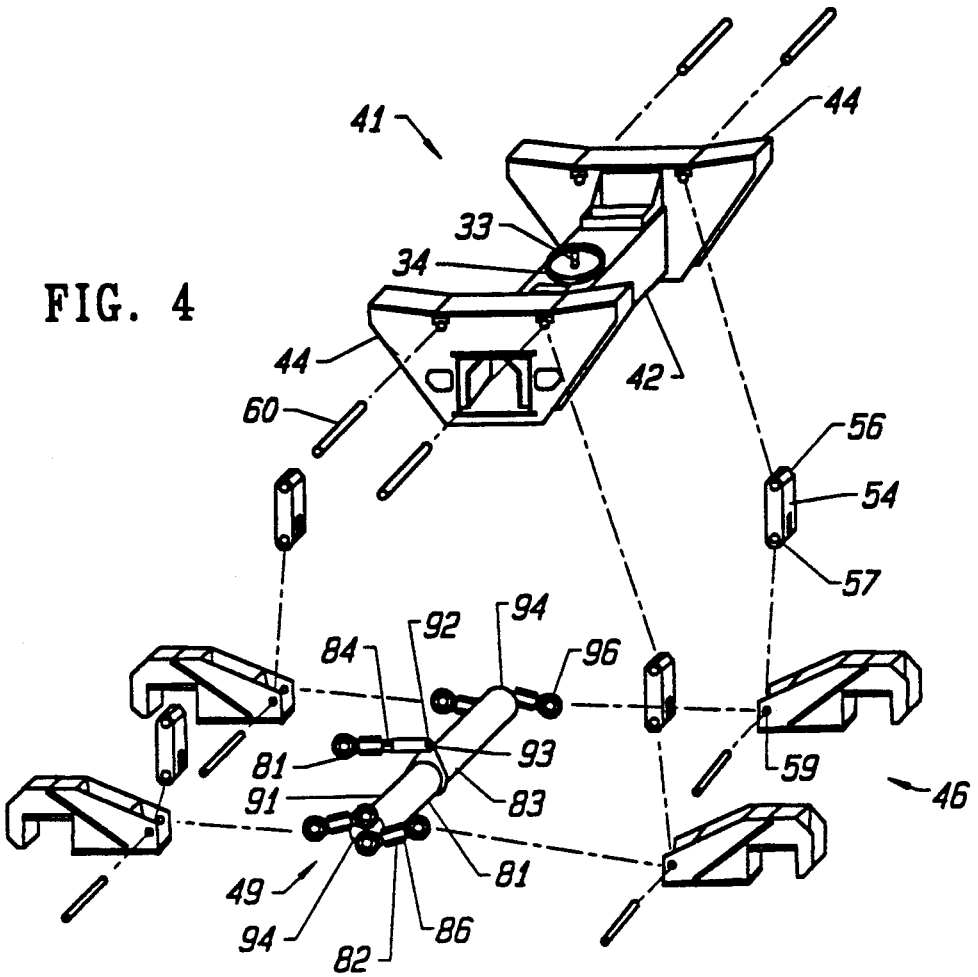
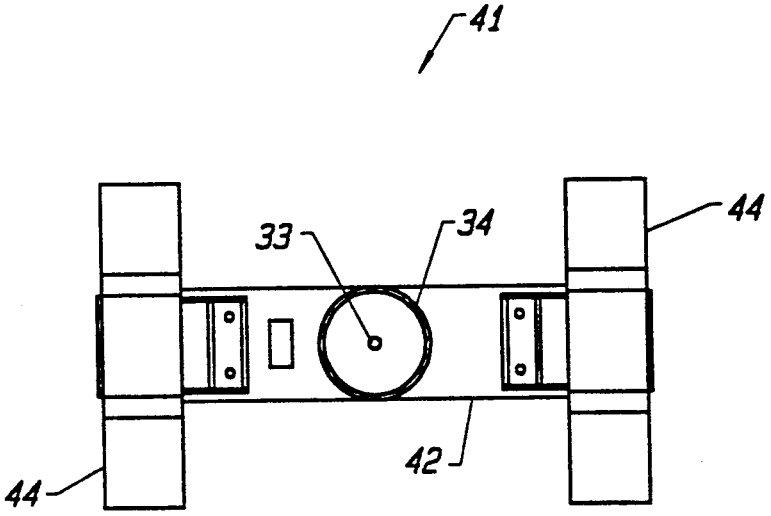
FIG. 5

23
W
S
R
L
21
Φcar
Φ'truck
d
b
92
91
94
96
41
θ
h
e

FORCED STEERING RAILROAD TRUCK SYSTEM WITH CENTRAL TRANSVERSE PIVOTED SHAFT

BACKGROUND OF THE INVENTION

The present invention relates generally to the railroad industry and, more particularly, to a railroad truck (commonly referred to as a "bogie" in many parts of the world) for supporting a railroad car.

A standard freight railroad car traditionally includes a truck at each end having two or more wheel sets to support the body of the railroad car. A conventional railroad freight truck is referred to as a three-piece truck design even though the truck has five or more major parts—a lateral bolster, two side frames and two wheel sets. (A wheel set is a rigid assembly of an axle, 2 wheels and bearings; each wheel is fixed to the axle and does not rotate independently.)

The structure of the traditional railroad truck permits operation on straight and curved track but has serious disadvantages. Trucks are able to negotiate both straight and curved sections of track by virtue of the tapered shape of each wheel and a traditional design that allows each wheel set axle to yaw in curves.

In more detail, depending on the point of contact between each wheel and the track, the wheel will have a different radius, and will traverse a different linear distance for each wheel rotation. On straight sections of track, each wheel of a wheel set ideally contacts the track at the same radius so that each wheel traverses the same linear distance for a given wheel rotation. On curved sections of track, the wheel contacting the rail on the outside of the curve contacts at a larger wheel radius, and traverses a larger linear distance than the wheel on the inside of the curve. These unequal wheel radii ideally cause the axle to yaw and thereby steer into the curve. Such wheel set yaw necessarily requires a non-rigid mounting between each wheel set and the truck.

The traditional three-piece railroad truck design provides this non-rigid mounting. Each side frame is aligned approximately parallel to a track and attaches to one end of each wheel set. The bolster is a cross-member which spans each side frame and is attached to the car body so as to provide for rotation of the truck relative to the car body in curves. The non-rigid attachment of each side frame to the bolster provides for movement of the side frame, and of the wheel set axles coupled thereto, relative to the truck bolster. The non-rigid attachment has historically been provided by a means for absorbing and releasing energy, such as by springs and/or springs and dampers, for example.

While the use of tapered wheels and a non-rigid wheel set mounting configuration that allows wheel set yaw, permits operation on straight and curved track sections, the traditional design is disadvantageous.

A problem faced by this conventional design is that even on straight track, the tapered wheel design causes the wheels to follow a sinusoidal path having a wavelength of about 55 to 65 feet. As a result of an initial alignment offset or some perturbing force, each wheel of a wheel set pair may contact the rail at a different radius. The difference in wheel radii cause the axle to adjust to the unequal radii by yawing away from the wheel rolling on the larger radius. The yaw is constrained to some maximum amount by the mounting between the side frame and the bolster and when this maximum is reached, the direction of yaw is reversed.

This results in the observe sinusoidal oscillation. The difference in wheel radii causes the traditional three-piece truck design to parallelogram, thereby creating rolling resistance and consequent wheel and track wear. The axle yaw acceleration increases with speed and may create lateral wheel forces sufficient for the wheel to climb the rail. Wheel axle yaw also creates lateral acceleration at frequencies that may be damaging to the railroad car structure or the lading.

In order to minimize the unfavorable effects of steering on straight track, the wheel set axle should be held rigid and perpendicular to the track. This goal may in principle be accomplished by increasing the turning moment and warp moment by increasing the stiffness and friction associated with the relative movements between the bolster and the car body and between the side frames and the bolster.

While the sub-optimal performance of the traditional three-piece truck design was tolerated in a less competitive transportation era, the availability of alternative transportation strategies has prompted the railroad industry to attempt to improve operating costs in the areas of improved fuel economy, lower maintenance, reduced lading damage, and better productivity, by running fewer cars faster, at higher capacity, and more often to achieve the same or higher annual tonnage.

However, an increase in stiffness and friction to improve straight track performance, contrarily reduces the effectiveness of steering on curved track sections by reducing the ability to yaw. The contrary requirements create a design impasse in the traditional three-piece truck.

Therefore, a problem faced by the railroad industry was how to simultaneously provide optimum or near-optimum operation on both straight and curved track. A major contributor to fuel consumption when an existing railroad truck is used, is rolling resistance. Rolling resistance also contributes to wheel and track wear, both being major components of maintenance cost. Lateral oscillations are a major contributor to lading damage. Finally, the existing railroad truck design also limits operating speeds to speeds established in the early 1900's.

The need for increased safety at any cost is enhanced by the recognized danger of transporting hazardous materials such as chemicals or nuclear materials.

There have been some attempts to solve the problems associated with the traditional truck, but these attempted solutions have by and large been technologically inadequate or economically infeasible.

So called self-steering radial trucks have been developed with a passive compliant connection between the wheel set axles to allow the axles to move radially on curves. This eliminates some of the problems associated with travel on curves but generally does not improve straight track performance and may actually create problems for travel on straight track so that steering on straight track becomes marginal. The designs require relatively unworn high conicity wheel trend profiles (e.g., 40:1) as commonly used outside the United States of America. In the United States of America wheel treads have a low conicity ratio (20:1). For low conicity profiles and for worn high conicity profiles, the use of passive compliant connection results in loose steering on straight track. These radial trucks have unstable motion characteristics (hunting) on straight track that leads to high friction and wear, as well as poor ride quality and the possibility of derailment.

Another attempt to improve performance involved cross linking a wheel from each wheel set on opposite sides of the truck to minimize parallelogramming of the axles and to minimize the hunting tendency. See, for example, U.S. Pat. No. 4,480,553 issued Nov. 6, 1984 to Scheffel. The cross linking of wheel sets links the wheel sets so that the natural steering forces generated by the differences in the wheel rolling radii at the rail contact point cause the trailing axle to urge the leading axle towards a radial position. This cross linking may effect some improvement for low speed freight, but generally cannot be applied at high speed because the hunting problem remains on straight track.

Another attempt to improve the performance is to couple truck wheel sets using solid arms and an elastomeric coupling material to allow relative movement between wheel sets. If such systems were designed as linear systems of elastomeric dampers for dominant frequencies, they may not provide the desired performance because the operational environment may be highly non-linear, particularly in light of truck, wheel and rail wear. See, for example, U.S. Pat. No. 4,781,124 issued Nov. 1, 1988 to List. However, this attempted solution does not provide both optimum straight and curved track performance.

Although prior art trucks may improve performance on curved track, they are not sufficient to satisfy other requirements. Each of these systems attempts to align each wheel set axle to the center of the curve. Unfortunately, because the conflicting requirements of maximum stiffness for straight track conflicts with the requirement for minimum stiffness for curved track operation, the solution is incomplete. Even if a passive steering system could be optimized for curves, its performance on straight track would be degraded.

Also, the steering force for a passive steering system is generated in response to the geometry of a single wheel set relative to the track, or at most to the geometry of the truck relative to the track. As such, the orientations of each wheel set of the truck or of the railroad car are uncoordinated.

There have been attempts to implement forced-steering systems which incorporate a linkage or flexure system to coordinate the movement of the two wheel set axles. See for example U.S. Pat. No. 4,295,428 issued Oct. 20, 1981 to Dickhart et al., and U.S. Pat. No. 3,789,770 issued February of 1974 to List. However, prior attempts to implement forced-steering have been inadequate.

SUMMARY OF THE INVENTION

The present invention advantageously overcomes the limitations in the conventional art and prior solutions by providing a truck that can be steered through curved track in an optimum manner and yet remain stable without hunting or oscillation in straight track sections. It includes several aspects. In one important aspect, the invention provides in a truck the combination of: a rigid frame having both a lateral arm providing means for rotatably securing the truck to the body of the railroad car and longitudinal end arms rigidly attached to it extending generally orthogonal thereto; means suspending the wheel sets from the frame allowing movement of the wheel sets relative to the frame longitudinally, rotationally in a horizontal plane, and vertically; and means connecting the body of the railroad car to the means for suspending, to control the wheel set movement.

In another important aspect, the means for connecting controls the wheel movement to correspond to the movement of the car body relative to the frame. Preferably the means for connecting controls the movement to align the wheel sets radially with the center of track curvature. The means for connecting is simply implemented by providing a rotatable member mounted for rotation relative to the frame, linking means coupled between the car body and the rotatable member for rotating the latter in response to the angular relationship, and means for moving the wheel sets longitudinally relative to the frame.

In another aspect of the invention, the suspension means suspends each of the wheels for movement essentially independently of the movement of the other wheels of the wheel sets. In one aspect, the means for suspension includes for each of the wheels, a pedestal having one end mounted to the axle of the wheel and an opposite end mounted for pivotal movement to permit the vertical movement of the one end, and a hanger mounted between the frame and the pedestal to allow the longitudinal movement. The means for suspension additionally most desirably includes for each wheel, means for rotatably coupling the pedestal to the location for the wheel sets.

In other aspects of the invention, various embodiments and combinations of embodiments of the frame, means for suspension, and means for connection are provided.

An object of the present invention is to provide a forced steering truck that can be attached to conventional railroad cars using a center pin and bowl receiver.

Another object of the present invention is to provide a forced steering truck that can be used with conventional wheel sets and is therefore retrofittable.

Another object of the present invention is to provide a forced steering truck that restrains the wheel set yaw on straight track to increase lateral stability and reduce hunting yet allow the wheel sets to align radially to the curve on curved track sections in order to reduce the angle of attack between the wheel and the rail and thereby reduce rolling resistance.

Another object of the present invention is to provide a forced steering system wherein the rotational angle between the car body and the wheel sets is used to effect an optimal steering alignment between the wheel sets and the rail irrespective of the forces interacting at the wheel to rail interface.

Another object of the present invention is to provide a steering system that is contained within the standard AAR dimensional envelope for a freight truck.

Another object of the present invention is to provide a rigid frame for use with or without forced steering.

Another object of the present invention is to provide a independent suspension for operation in conjunction with the forced steering system.

Another object of the present invention is to provide a truck wherein the wheel sets can be precisely statically aligned.

Another object of the present invention is to provide a forced steering system wherein a large amount of vertical suspension travel is provided without causing wheel set misalignment.

Another object of the present invention is to provide a system wherein the wheel set bearings are compatible to hot box detection.

Other features and advantages of the invention will be more readily apparent to those skilled in the art, after review of the following more detailed description of the invention.

BRIEF DESCRIPTION OF THE DRAWINGS

With reference to the accompanying drawings:

FIG. 4 is an exploded perspective view of aspects of the suspension and steering portion of the embodiment of a forced steering truck system illustrated in FIG. 2;

FIG. 5 is an illustration which shows an embodiment of the frame according to the present invention;

DETAILED DESCRIPTION OF THE PREFERRED EMBODIMENTS

Figure 1:
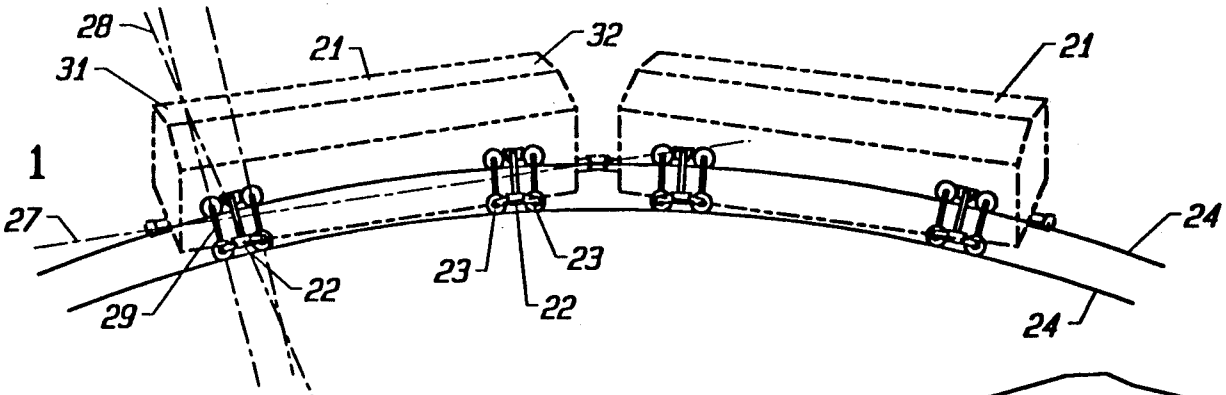
FIG. 1 is an illustration which shows a perspective view of two railroad cars including the railroad tracks and the relationships between the wheel sets of each of the cars, track, and railroad car body.

FIG. 1 shows generally the positional relationship between a railroad car body 21, a truck 22, wheel sets 23, and the track 24. The railroad car has a longitudinal axis 27 generally defining the intended forward and reverse directions of travel of the car on straight railroad track. Each wheel set axle axis is nominally aligned to a lateral axis 28 which is approximately orthogonal to the railroad car longitudinal axis when the car is positioned on straight track. The relative rotation between the rail car 21 and the truck 22 on curved track cause the lateral axis 28 to depart from orthogonality with the longitudinal axis on curved track sections. The steering movements described below cause the wheel set axles 29 to advantageously depart from the nominal orthogonal alignment on curved track.

The railroad car 21 has two ends 31, 32, separated along the longitudinal axis 27. Each rail car end 31, 32 is supported by a truck 22 which is interposed between the truck wheel sets 23 and the car body 21. The truck 22 is coupled to the car body in a manner that permits rotations of the same relative to the car body 21 in curves. While the illustration shows two trucks 22 associated with each railroad car 21, and two wheel sets 23 associated with each truck 22, embodiments of the present invention having different numbers of trucks or wheel sets are contemplated. For example, a rail car 21 having a single truck 22, or a rail car 21 having three, four, or more trucks 22 may advantageously employ aspects of the present invention. Furthermore, while trucks having two wheel sets are illustrated and described, trucks having a single wheel set or more than two wheel sets may be advantageously used with the present invention with appropriate modifications. When different numbers of wheel sets are used the various linkages, couplings, and anchor points (described subsequently) will be modified according to the principles of the present invention. Furthermore, motor-driven wheel sets may similarly be connected and steered according to the principles of the present invention. The invention is applicable to all types of rail guided vehicles, including passenger and freight.

Figure 2:
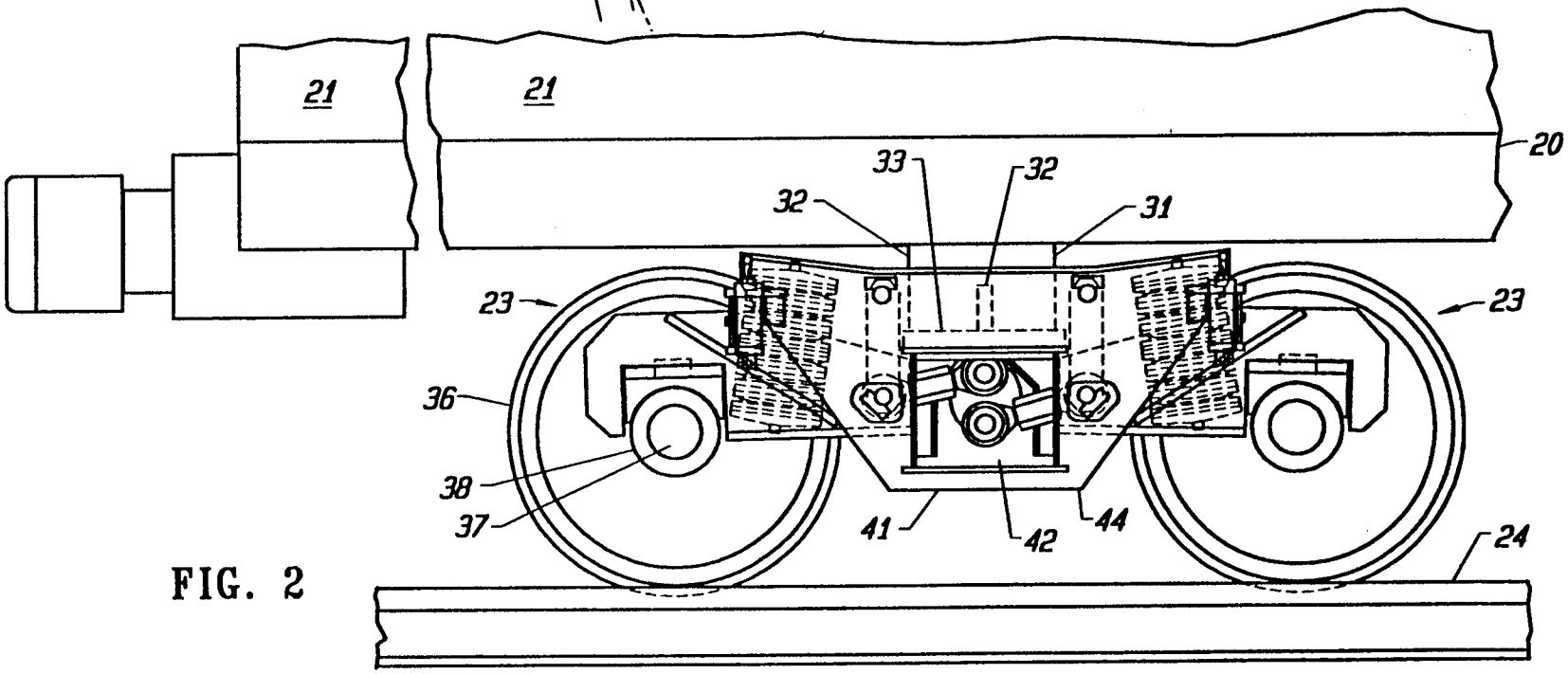
FIG. 2 is an illustration which shows a side elevation of a railroad car body, an embodiment of a truck according to the present invention, and a railroad track.

The operation of each truck 22 is essentially the same and only one will be described in detail. FIG. 2 is an illustration which shows a side elevation view of a railroad car body 21, an embodiment of the truck 22 according to the present invention, two wheel sets 23, and a track rail 24. A wheel set 23 comprises two wheels 36, an axle 37, and an axle bearing 38 adjacent each wheel. The side elevation shows only one wheel 36 for each of the two wheel sets 23, the wheels on the opposite side of the truck being hidden in the drawing. The present invention may be used in conjunction with conventional wheel sets without modification or may be applied to other wheel set configurations. It also is compatible with the standard means for attaching a conventional truck bolster to a railroad car body 21, which means is conventionally made up of a center pin 33 and a ring 34 which couples to a bowl receiver (not shown) on the railroad car 21 undercarriage 20. A wear liner (not shown) may be employed between the ring 34 and the bowl receiver to provide a substantially constant friction force. Therefore, embodiments of the present invention may be easily retrofitted to existing railroad car bodies and wheel sets in place of conventional trucks.

Figure 3:
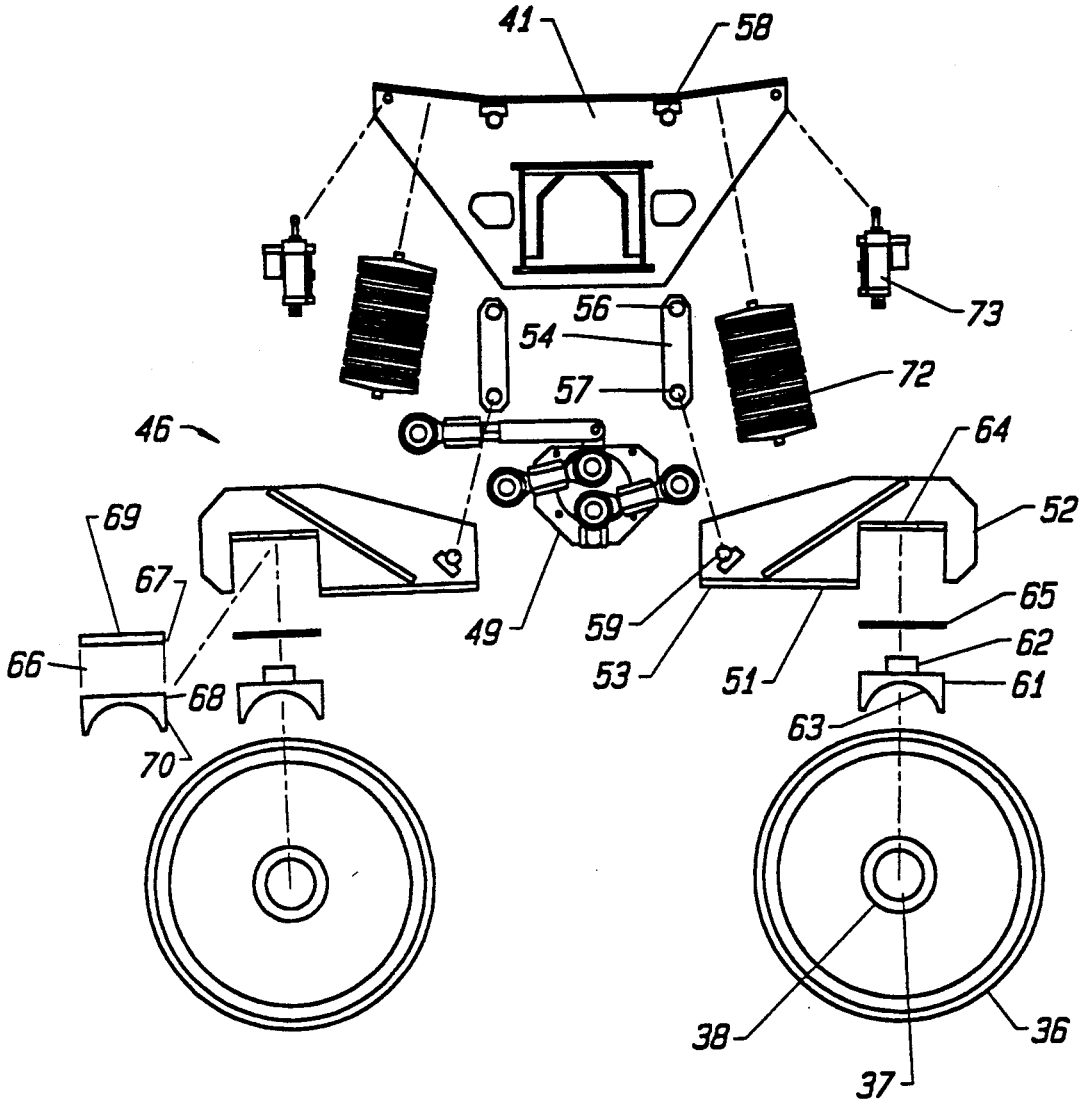
FIG. 3 is an illustration which shows an exploded side elevation view of the embodiment of a forced steering truck system of FIG. 2 incorporating the present invention.

FIGS. 3 and 4 are illustrations which shows an exploded view of a preferred embodiment of a forced-steering truck system according to the present invention. A truck for supporting a railroad car longitudinally on a track 24 (not shown in either FIG. 3 or FIG. 4) with two wheel sets. The truck 22 comprises a rigid frame 41, means 46 for suspending the wheel sets, and means 49 for connecting the car body to the means for suspending, to control wheel set movement.

A rigid frame 41 having both a lateral arm 42 and longitudinal end arms 44 rigidly attached to the lateral arm 42 and extending generally orthogonal thereto is shown. The lateral arm 42 has means for rotatably securing the truck to the body of the railroad car. Also illustrated are elements of the means for suspending the wheel sets from the frame and allowing movement of the wheel sets relative to the frame 41 longitudinally, vertically, and rotationally in a plane parallel to a plane defined by the contact points between the wheels 36 and the rail, which plane is located between the frame and the location for the wheel sets 23. Also illustrated are the means 49 for connecting the body of the railroad car 21 to the means 46 for suspending, to control the wheel set movement. Each of these means is described in greater detail below.

In the preferred embodiment the frame 41 is a single piece structure comprising a lateral arm 42 and two longitudinal end arms 44 as best illustrated in FIG. 5. The frame 41 is fabricated from flat plate material and assembled as a rigid weldment. However, other methods of fabricating the frame 41 such as forging, casting, and fabrication and assembly from other than flat plate is appropriate. A feature of the frame is that it is sufficiently stiff that the forces created by the contact between the wheels and the rail do not misalign the axes or axles or otherwise distort the frame beyond a tolerable level. The frame is similarly sufficiently rigid that the angle between the car body and the truck (including the frame 41) is accurately translated into the desired steering force without frame distortion that would undesirably alter the steering geometry.

The means for rotatably securing the truck to the body of the railroad car comprises a ring 33 and a coupling pin 32 for coupling to a receiving structure on the car body 21. The lateral arm 42 and the longitudinal end arms 44 may incorporate various internal supports partitions which define cavities and stiffen and strengthen the frame 41. These supports and cavities define locations wherein other elements such as elements of the forced steering system described subsequently, may be located. In particular, the bearing supports for the means for connecting 49 are attached to supports within the lateral arm 42 of frame 41. The longitudinal arm preferably provides various cut-outs and access holes to facilitate inspection, adjustment, and maintenance of the suspension and steering mechanisms.

FIGS. 3 and 4 illustrate details of one embodiment of the means 46 for suspending. Alternate embodiments incorporating means for suspension of each wheel set axle rather than for each wheel 36 of a wheel set 23 may be provided.

In this preferred embodiment, the means 46 for suspension, suspends each of the wheels 36 for movement independent of the movement of the wheels 36 of the other wheel sets 23. The means for suspension includes for each of the wheels 36, a pedestal 51 having one end 52 mounted to the axle 37 of the wheel set 23, and an opposite end 53 mounted for pivotal movement to permit vertical movement of the end 52. Also, a hanger 54 is mounted between the frame 41 and the pedestal 51 to allow longitudinal wheel movement and substantial vertical suspension travel without altering the wheel set alignment. Therefore the system is suitable for high capacity freight cars. A first hanger end 56 is rotatably attached to a frame attachment 58, permitting pivotal movement about the point of attachment 58. A second hanger end 57 is rotatably attached to the pedestal attachment 59, proximate pedestal end 53 permitting pivotal movement about the pedestal attachment 59. Hanger 54 is attached to the frame and pedestal by means for pivotally attaching, such as by a pin 60 of sufficient cross section to provide the required strength and to facilitate rotation without excessive friction. Pin 60 also provides a cylindrical bearing surface to facilitate rotation. Each hanger 54 should be fabricated in such a manner that it is torsionally rigid. Bushings or other friction reduction means may be provided between the pin 60 and the hanger 54.

The means for suspension also includes for each wheel 36, means 52 for rotatably coupling each pedestal to the location for wheel sets 23. In the embodiment shown the means for rotatably coupling each pedestal comprises a cylindrical bearing adapter 61. The bearing adaptor includes a cylindrical bearing 62 that couples to the pedestal 51 via a hole 64 which receives the cylindrical bearing 62. The result is that the desired wheel set axle rotation is provided without the frame 41 geometry being distorted when the rail car transits a curved section of track particularly when steering forces are applied. A bearing wear liner 65 is interposed between the pedestal 51 and the cylindrical bearing adapter 62 to provide a substantially constant coefficient of friction (typically 0.16) and to minimize component wear. The bearing adapter 61 also comprises an axle bearing coupling 63 on the opposite side from the cylindrical bearing 62 for coupling to each wheel set axle bearing box 38 (FIG. 2). The cylindrical bearing adapter 61 permits reorientation of the wheel sets 23 relative to the frame 41. It may also provide more even bearing loading on the wheel bearings 38 to minimize wear. Alternatively, the means for rotatably coupling may comprise a ball and socket joint (not shown) interposed between the pedestal 51 and the axle bearing coupling 63.

In alternative embodiment that is illustrated, the means for rotatably coupling 61 may comprise an elastomeric block 66 having one end 67 coupled to the pedestal 51 and a second end 68 coupled to the wheel set axle bearing box 38. The composition and volume of the elastomeric block 66 are chosen so that the opposing ends 67, 68 of the block may undergo relative rotation under an applied torsional force. Additional face plates 69, 70, made, for example from metal on each block surface may also be used to couple the block 66 to the pedestal 53 and bearing axle 38.

The means 46 for suspending may additionally include means for storing and releasing energy interposed between each pedestal 51 and the frame 41. In the embodiment illustrated in FIG. 3, the means for storing and releasing energy comprises a spring 72 and a damper 73 for each wheel. Multiple springs and/or dampers may also be employed for each wheel. Such springs may be provided by one or more conventional coil springs, by an elastomer, or by a plurality of Belville spherical washers, or by other alternatives. Conventional leaf springs may also be used. The damper may be one of a common conventional type of shock absorber, and may be combined with the spring, particularly if an elastomeric material is used.

Alternatively the means for storing and releasing energy may comprise an elastomeric absorber (not shown) formed in place between the frame 41 and the pedestal 51, such as by using a substantially fluid material that solidifies in place after being applied as a fluid. Moreover, the means for suspension need not suspend each wheel 36 independently but instead provide separate suspension for each wheel set.

The means 49 for connecting may comprise several elements and controls the wheel set movement to align the wheel sets with the track in response to the angular relationship of the car body to the track. Preferably it is desirable to align the wheel sets radially with the center of track curvature so that the axis of rotation of the wheel set axles, points to the center of track curvature.

A preferred embodiment of the means for connecting the body of the railroad car to the means 46 for suspending so as to control the wheel set movement is illustrated in FIG. 4. Elements of an embodiment of the means for suspending previously described are also illustrated so that the relationship between these particular elements and their operation can be more clearly understood.

The means 49 for connecting controls the wheel set movement to correspond to the movement of the car body relative to the frame 41. In the preferred embodiment, the means for connecting comprises a means 81 for generating an alignment force 81 in response to the angular relationship of the car body 21 to the truck 22 and indirectly to the track 24, and means 82 for directing the alignment force to the means 46 for suspending, for aligning the wheel sets 23 with the track 24.

The means 81 for generating comprises a rotatable member 83 mounted for rotation relative to the frame 41, wherein said rotational axis is preferably generally transverse to the railroad car longitudinal axis, or equivalently, generally parallel to the wheel set axle axis; and means 84 for linking, coupled between the car body 21 and the rotatable member 83 for rotating the latter in response to the angular relationship of the car body 21 to the track 24.

In the embodiment shown in FIG. 4, the means for directing 82 comprises means 86 for moving the wheel sets longitudinally relative to the frame 41, coupled between the rotatable member 83 and the means for suspending 46. More particularly, the coupling is between the rotatable member 83 and the pedestal 51.

Figure 6A:
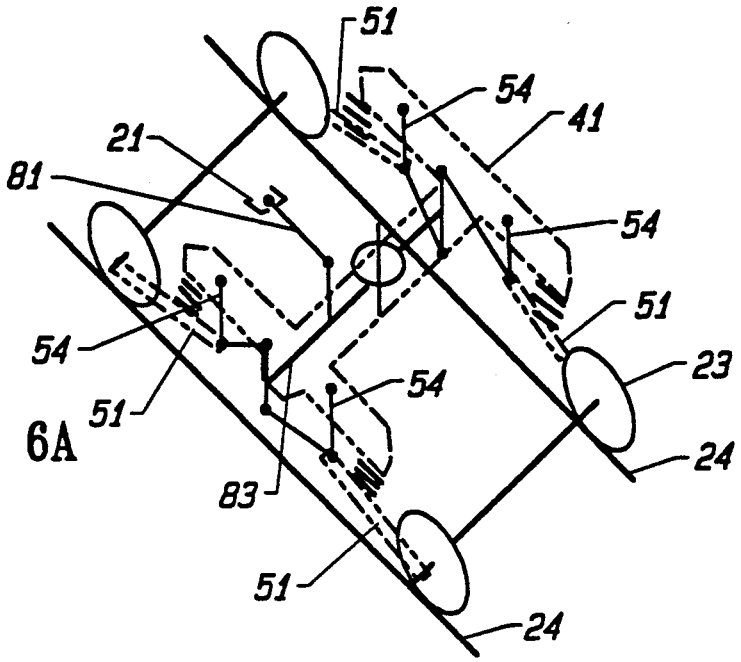
FIG. 6A is an illustration which shows a graphical representation of wheel set orientation relative to the track and frame for straight track operation.
Figure 6B:
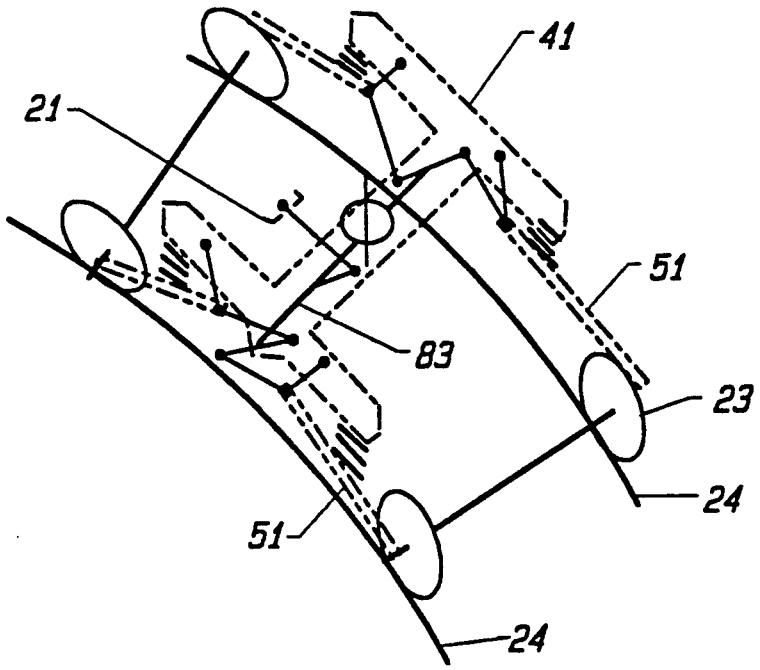
FIG. 6B is an illustration which shows a graphical representation of wheel set orientation relative to the track and frame for curved track operation.

The operation of the forced-steering system is illustrated in FIGS. 6A and 6B. FIG. 6A is a graphical representation of the relationship between the track 24, wheel sets 23, frame 41, the point of attachment to the railroad car body 21, and elements of the means 49 for connecting, for a truck and car body on straight track. FIG. 6B is an analogous graphical representation of the relationships for a railroad car and truck on curved track.

Each of these figures illustrates the manner in which means 49 for connecting comprised of the means 81 for generating an alignment force and the means 82 for directing the alignment force effects a change in the angular orientation (yaw) of the wheel sets 23. In particular, the illustration shows how the means 81 for generating coupled between the railroad car 21 and the rotatable member 83 mounted for rotation relative to the frame 21, imparts a rotation to the rotatable member 83, which in turn directs a force to the means 86 for directing the alignment force, coupled between the rotatable member 83 and the means 46 for suspending, including the hangers 54, and the pedestals 51. The effect of these steering forces and the mechanism is to change the wheel separation differentially on each side of the truck. On the outside wheels the separation is increased. On the inside wheels the separation is simultaneously decreased. In the preferred embodiment the movement of each of the inside wheels is equal in magnitude but opposite in direction. The movement of each of the outside wheels is analogously equal in magnitude but opposite in direction. These movements yaw the wheel sets so that they orient to the curve. The connection to the car body provides a long baseline over which the steering alignment force is derived. This long baseline provides increased stability on straight track sections and also provides a more accurate alignment for curved track sections.

Figures 7, 8A, 8B:
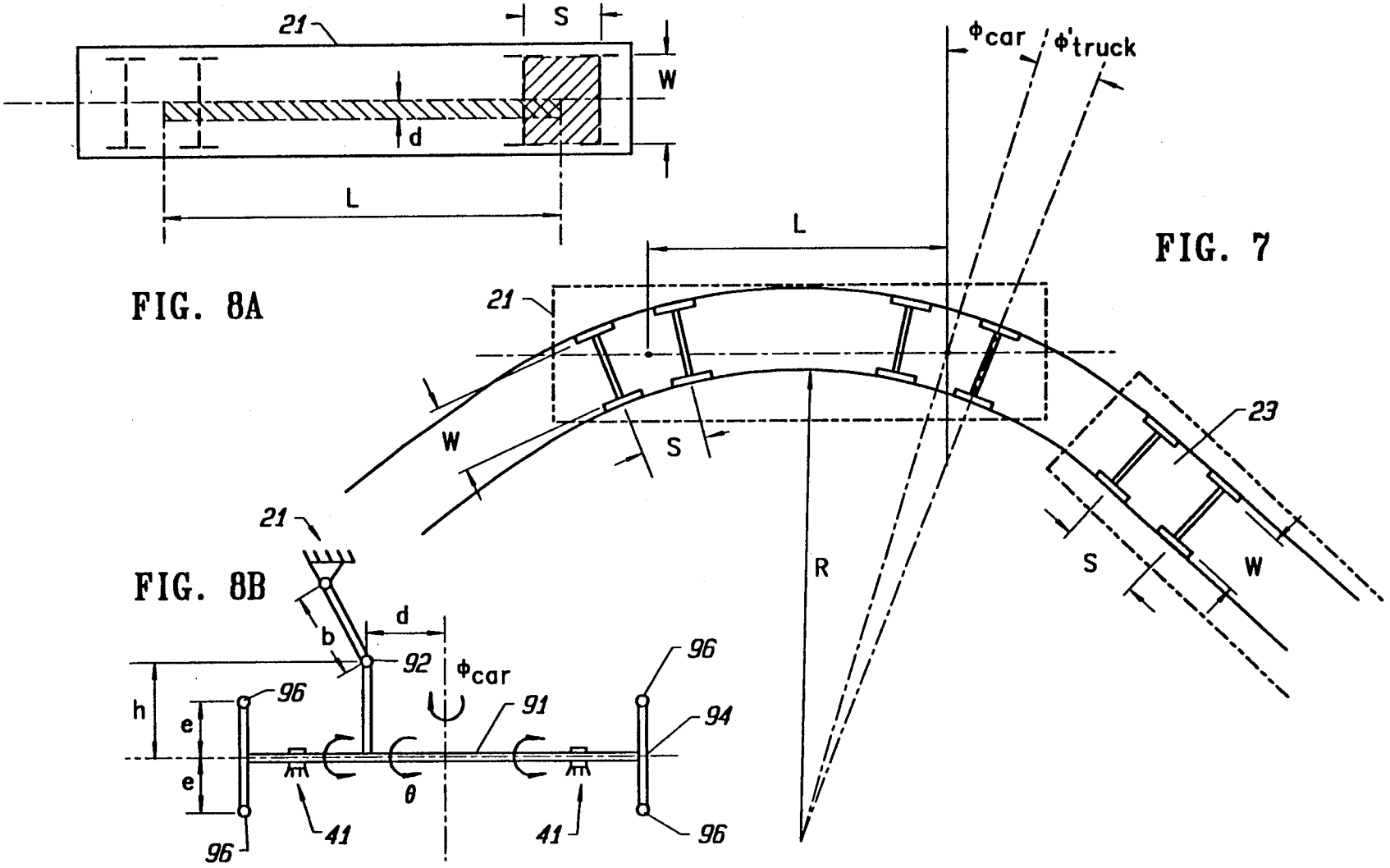
FIG. 7 is an illustration which shows the geometrical relationship between the wheel sets, the truck, the railroad car body, and the track for an embodiment of the present invention.
FIGS. 8A–8C are illustrations which show the relationship between components of a portion of the forced steering system according to one embodiment of the present invention.

FIG. 7 is an illustration which shows the geometrical relationships between the wheel sets, the truck, the railroad car body, and the track, in analogy to the diagrams of FIGS. 6A and 6B. In particular the change in wheel set 23 orientation with respect to straight and curved sections of track is illustrated. The optimum geometry will be described in reference to FIG. 7 subsequent to a more detailed description of the components of an embodiment of the forced-steering system.

Figure 8C:
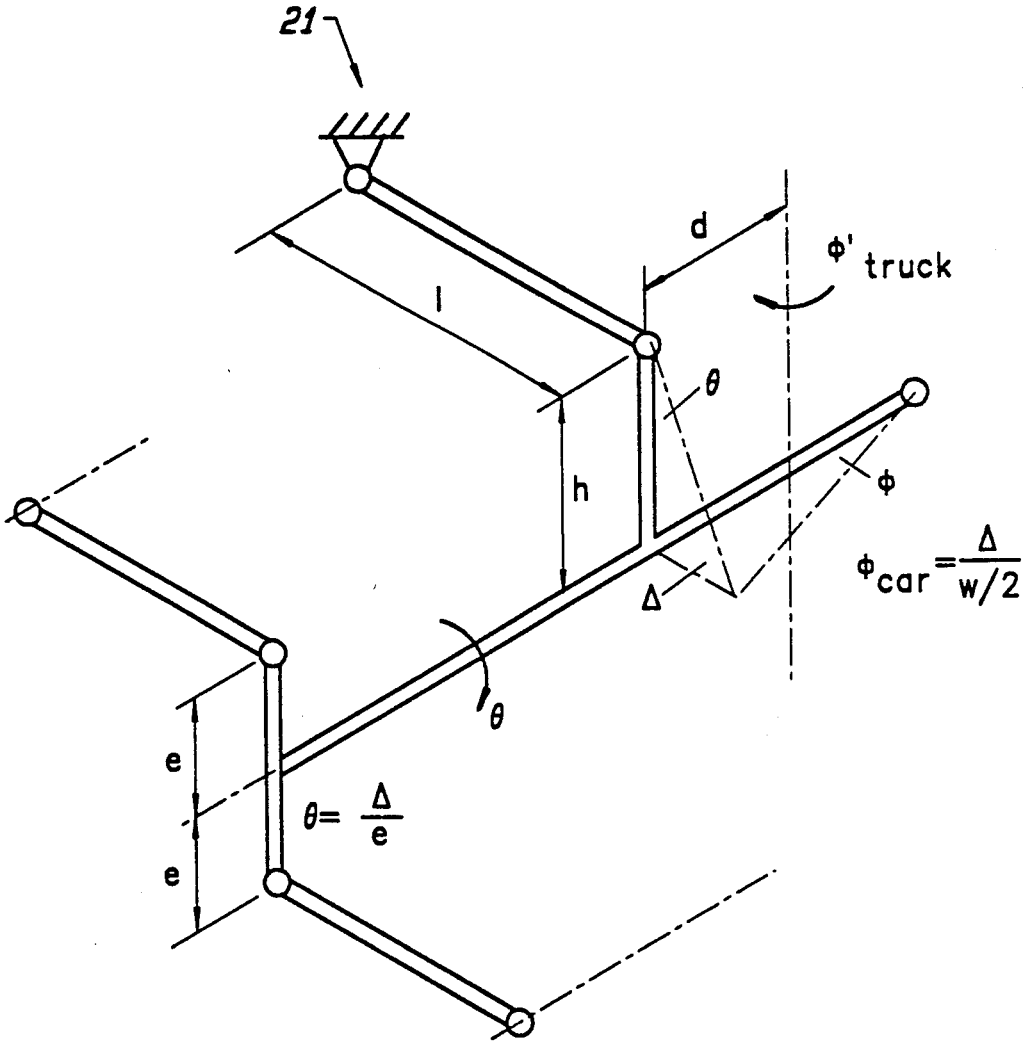

FIG. 8 is an illustration which shows the relationship of several elements of the rotatable member 83. The illustration is not intended to describe a particular physical structure such as shaft diameters or methods of attachment. As such it is not drawn to scale. In particular, different shaft diameters may be needed to provide sufficient load capability. The rotatable member 83 comprises a shaft 91, such as a torque tube for example, rotatably mounted to the frame 41, first means 92 for attachment to the shaft 91 at an attachment location 93 medial to the shaft ends 94 at a distance, d, from the center of rotation of the truck 22 and at a first distance, h, from the axis of rotation of the shaft 91. This center of rotation is typically defined by the location of the king pin center pin 33, and related ring 34 and bowl receiver described previously. The rotatable member 83 also comprises second means for attachment 96 to the shaft 91 at an attachment location 97 proximal to the ends 94 of the shaft 91 at a second distance, e, from the axis of rotation of the shaft 91. The coupling between the medial attachment location 93 and a railroad car body attachment has a dimension b.

The means 49 for connecting in the preferred embodiment of the invention, comprises the linkage to the car body 84, guided through an opening in the top of the frame lateral arm 42 to connect to the medial attachment point of the means for directing thereby forming a load path through which forces are distributed. The means for directing has an orientation fixed with respect to the truck so that car body rotation relative to the truck induces a steering force into the means for directing, is distributed to the pedestals 51 and ultimately to the wheel sets 23.

The preferred embodiment of the means for directing comprises adjustable spherical ball joints 96 at ends of the pedestal links 82 (FIG. 4) and the car body link 84, to ensure good alignment. The rotatable member 83 is fabricated from tube stock with welded end plates.

In the preferred embodiment, one or more of the linkages has an adjustable length so that the linkage geometry may be precisely aligned. In conventional trucks the wheel set alignment is established by the dimensions of other components (hopefully within specified tolerances) and is not adjustable except by re-machining, such as by grinding the various components.

An alternative embodiment that may be preferable when decreased unit cost is desirable, uses bars that will provide the same limited range of movement by flexure, as do the ball joints, in response to the forces directed to them by the shaft rotation. These bars may be fabricated from composite materials.

The hangers 54 provide lateral translation of the pedestal (and the wheel) in response to rotation of the shaft. In a preferred embodiment the hangers are fabricated from sheet stock, however, equally advantageous are hangers fabricated or cast from other materials such as aluminum or composite materials.

With reference to FIG. 7, in the preferred embodiment of the invention wherein the railroad car 21 is supported by at least two trucks 22 separated by a center distance L, wheel sets 23 have a separation W, and the wheels 36 of each of the wheel sets 23 have a separation distance S, the rotatable shaft is implemented such that the first distance h, the second distance e, and the medial distance d, are chosen to satisfy the relationship $e/h = WS/2Ld \pm \text{tolerance}$. When this relationship is satisfied for a tolerance $=0$, the truck wheel sets 23 will be steered precisely through a curve with each wheel set axle 37 aligned with the center of curvature of the track. This condition minimizes rolling friction, wheel and rail wear, and so on. It also maximizes fuel economy and increases safety. The ride is improved because noise and oscillations is reduced or eliminated on curved and straight track. When there is a error in the parameters such that the tolerance is non-zero, the truck 22 will be over or under-steered by some amount.

The above relationship for perfect steering geometry is derived from a consideration of the geometrical relationships illustrated in FIGS. 7 and 8. For radial alignment of the rotational member (which is rotationally attached to the frame 41) and the wheel set axles, the parameters must satisfy the relationships:

$$\phi_{car}=\sin^{-1}[(L/2)/R]$$

and $$\phi'_{truck}=\sin^{-1}[S/2)/R]$$

For small angles, between about −15 degrees and +15 degrees, these relationships are approximately, $$\phi_{car}\approx L/2R$$

and $$\phi'_{truck}\approx S/2R.$$

Under these conditions $$\phi_{car}=\Delta'/d,$$

and $$\theta=\Delta'/h.$$

Then, $$\theta=\phi_{car} * d/h$$

or equivalently $$\theta=(d/h)* \phi_{car},$$

where $\phi_{car}$ is the angle of rotation of the shaft about the truck center of rotation, and $\theta$ is the resulting angle of rotation of the shaft about its own axis.

The relationship of $\theta$ to $\phi_{car}$ is in general, both non-linear and non-symmetrical. For small values of $\phi_{car}$, between about −15 degrees and +15 degrees, the linearizing approximation $$\theta=(d/h) * \phi_{car}$$

is a useful simplification. The additional assumption that $\theta$ is small, between about −15 degrees and +15 degrees, yields the relationship $$\phi'_{truck}(\text{actual})=(e\ d\ L)/(W\ h\ R).$$

The over-steer angle, which is the difference between the actual $\phi'_{truck}$ and required steering angles, is then given by:

$$\begin{aligned}\Delta\phi'_{truck} &= \phi'_{truck}(\text{actual}) - \phi'_{truck}(\text{required})\\ &= (edL/WhR) - (S/2R)\\ &= (1/R)[(edL/Wh) - (S/2)].\end{aligned}$$

In order to reduce the under-steer angle to zero, the parameters must satisfy the relation $$e=(Wsh)/(2dL).$$

When the conditions for which $\Delta\phi'_{truck}=0$ are satisfied, there is no over- or under-steer and is independent of curve radius R. However, when the condition is not satisfied, then $\Delta\phi'_{truck}$ does depend on the curve radius R. Thus when the condition is not satisfied the magnitude of any over- or under-steer depends on the particular curve radius on which the railroad car is transiting.

In a possible embodiment of the invention, a rotatable shaft 83 is provided wherein one or more of the first distance, the second distance, and/or the medial distance are adjustable.

In one embodiment of the invention, the lengths of each of the linkages are adjustable. This adjustability provides for better alignment of the truck wheel sets 23 upon assembly from the components, and better maintainability to compensate for wear. Alternatively, the linkages themselves may be replaced by substitute units having different characteristics, so that a truck 22 may be optimally configured for car body length. Multiple alternative medial attachment locations may be provided, and multiple car body attachment locations may similarly be provided so that the truck can be configured optimally for the particular car body characteristics and truck wheel set separations.

Although the invention has been described in connection with a preferred embodiment thereof, it will be recognized by those skilled in the art that various changes and modifications can be made without departing from its spirit. For example, the rigid frame described herein may be used without the aforedescribed forced steering or suspension components. Additionally, the linkage to the car body may be eliminated and the steering or centering effort provided by a different source so that the truck is restrained on straight track but passively steered on curved track in response to rail-wheel forces, or some other force producing mechanism.

It is therefore intended that the coverage afforded Applicant be limited only by the claims and their equivalents.

What we claim:

1. In a truck arrangement for supporting a railroad car longitudinally on a track by at least two trucks separated by a center distance L, each of which has at least two wheel sets with a separation distance W and the wheels of each wheel set having a separation distance S; the combination comprising:

I) a frame having both a lateral arm providing means for rotatably securing said truck to the body of said railroad car and longitudinal end arms rigidly attached to said lateral arm and extending generally orthogonal thereto;

II) means for suspending said wheel sets from said frame and allowing movement of said wheel sets relative to said frame longitudinally, rotationally in a horizontal plane, and vertically, located between said frame and the location for said wheel sets; and III) means connecting said body of said railroad car to said means for suspending, for controlling said wheel set movement to correspond to the movement of said car body relative to said frame and to align said wheel sets with said track in response to the angular relationship of said car body to said track, said means for connecting comprising:

a) a rotatable member mounted for rotation relative to said frame, said rotatable member comprising:
i) a shaft rotatably mounted to said frame;
ii) first means for attachment to said shaft at an attachment location medial to ends of said shaft at a distance, d, from the center of rotation of said truck and at a first distance, h, from the axis of rotation of said shaft; and
iii) second means for attachment to said shaft at an attachment location proximal to said ends of said shaft at a second distance, e, from said axis of rotation of said member;
b) means for linking coupled between said car body and said rotatable member for rotating the member in response to said angular relationship; and
c) means for moving said wheel sets longitudinally relative to said frame, coupled between said member and said means for suspending;

said first distance h, said second distance e, and said medial distance d, being chosen to satisfy the relationship $e/h = WS/2Ld$.

2. The truck of claim 1 wherein said means for connecting controls said movement to align said wheel sets radially with the center of track curvature.

3. The truck of claim 1 wherein said means for connecting comprises:
a) means for generating an alignment force in response to said angular relationship of said car body to said track; and
b) means for directing said alignment force to said means for suspending, for aligning said wheels sets with said track.

4. The truck of claim 3 wherein said means for generating comprises:
a) a rod mounted for rotation relative to said frame; and
b) means for linking coupled between said car body and said rod for rotating the latter in response to said angular relationship.

5. The truck of claim 3 wherein said means for directing includes means for moving said wheel sets longitudinally relative to said frame, coupled between said rod and said means for suspending.

6. The truck of claim 1, wherein said first distance, said second distance, and said medial distance are adjustable.

7. The truck of claim 1 wherein said means for suspension suspends each of the wheels provided by said wheel sets for said movement independently of said movement of the other wheels of said wheel sets.

8. The truck of claim 1 wherein said means for connecting comprises:
a) means for generating an alignment force in response to said angular relationship of said car body to said track; and
b) means for distributing said alignment force to said means for suspending for aligning said wheels sets with said track.

9. The truck of claim 8 wherein said means for generating comprises:
a) a rotatable member rotatably mounted to said frame; and
b) means for linking coupled between said car body and said rotatable member for rotating said member in response to said angular relationship.

10. The truck of claim 8 wherein said means for distributing comprises:
a) means for moving said wheel sets longitudinally relative to said frame, coupled between said rotatable member and said means for suspending.

11. The truck of claim 8 wherein said means for suspension includes for each of said wheels;
a) a pedestal having one end mounted to the axle of said wheel and an opposite end mounted for pivotal movement to permit said vertical movement of said one end; and
b) a hanger mounted between said frame and said pedestal to allow said longitudinal movement.

12. The truck of claim 11 wherein said means for suspension includes for each said wheel, means for rotatably coupling each said pedestal to said location for said wheel sets.

13. The truck of claim 1 wherein said means for suspension includes for each of said wheels;
a) a pedestal having one end mounted to the axle of said wheel and an opposite end mounted for pivotal movement to permit said vertical movement of said one end; and
b) a hanger mounted between said frame and said pedestal to allow said longitudinal movement.

14. The truck of claim 1 wherein said means for rotatably coupling each said pedestal comprises an elastomer.

15. In a truck arrangement for supporting a railroad car longitudinally on a track by at least two trucks separated by a center distance L, each of which has at least two wheel sets with a separation distance W and the wheels of each wheel set having a separation distance S; the combination comprising:
I) a frame having both a lateral arm providing means for rotatably securing said truck to the body of said railroad car and longitudinal end arms rigidly attached to said lateral arm and extending generally orthogonal thereto;
II) means for suspending said wheel sets from said frame and allowing movement of said wheel sets relative to said frame longitudinally, rotationally in a horizontal plane, and vertically, located between said frame and the location for said wheel sets; and
III) means connecting said body of said railroad car to said means for suspending, for controlling said wheel set movement to correspond to the movement of said car body relative to said frame and to align said wheel sets with said track in response to the angular relationship of said car body to said track, said means for connecting comprising:
a) a rotatable member mounted for rotation relative to said frame, said rotatable member comprising:
i) a shaft rotatably mounted to said frame;
ii) first means for attachment to said shaft at an attachment location medial to ends of said shaft at a distance, d, from the center of rotation of said truck and at a first distance, h, from the axis of rotation of said shaft; and
iii) second means for attachment to said shaft at an attachment location proximal to said ends of said shaft at a second distance, e, from said axis of rotation of said member;
b) means for linking coupled between said car body and said rotatable member for rotating the member in response to said angular relationship; and
c) means for moving said wheel sets longitudinally relative to said frame, coupled between said member and said means for suspending;

said means for suspension suspending each of the wheels provided by said wheel sets for said movement independently of said movement of the other wheels of said wheel sets; and said first distance h, said second distance e, and said medial distance d, being chosen to satisfy the relationship $e/h=WS/2Ld$.

16. The truck of claim 15 wherein said means for connecting provides the control by moving said wheel sets to align said wheel sets radially with the center of track curvature.

17. The truck of claim 15 wherein said first distance, said second distance, and said medial distance are adjustable.

18. The truck of claim 15 wherein said means for suspension includes for each of said wheels;

a) a pedestal having one end mounted to the axle of said wheel and an opposite end mounted for pivotal movement to permit said vertical movement of said one end; and b) a hanger mounted between said frame and said pedestal to allow said longitudinal movement.

19. The truck of claim 18 wherein said means for suspension includes for each said wheel, means for rotatably coupling each said pedestal to said location for said wheel sets.

20. The truck of claim 19 wherein said means for rotatably coupling each said pedestal comprises an elastomer.

21. The truck of claim 15 wherein said means for rotatably coupling each said pedestal comprises an elastomer.

22. In a truck for supporting a railroad car longitudinally on a track with at least two wheel sets, the combination comprising:

I) a frame having both a lateral arm providing means for rotatably securing said truck to the body of said railroad car and longitudinal end arms rigidly attached to said lateral arm and extending generally orthogonal thereto;

II) means for suspending said wheel sets from said frame and allowing movement of said wheel sets relative to said frame longitudinally, rotationally in a horizontal plane, and vertically, located between said frame and the location for said wheel sets, said means for suspension suspending each of said wheels for said movement independently of movement of the other wheels of said wheel sets and comprising:

a) a pedestal having one end mounted to the axle of said wheel and an opposite end mounted for pivotal movement to permit said vertical movement of said one end; and b) a hanger mounted between said frame and said pedestal to allow said longitudinal movement; and c) means for rotatably coupling each said pedestal to said location for said wheel sets; and III) means connecting said body of said railroad car to said means for suspending, for controlling said wheel set movement, said means for connecting comprising:

a) a rotatable member rotatably mounted to said frame comprising:

i) a shaft mounted to said frame for rotation on an axis which is generally transverse to the railroad car longitudinal axis;

ii) first means for attachment to said shaft at an attachment location medial to ends of said shaft at a first distance from the axis of rotation of said member; and iii) second means for attachment to said shaft at an attachment location proximal to said ends of said shaft at a second distance from said axis of rotation of said member;

b) means for linking coupled between said car body and said rotatable member for rotating said member in response to said angular relationship; and c) means for moving said wheel sets longitudinally relative to said frame, coupled between said rotatable member and said means for suspending.

23. In a truck for supporting a railroad car longitudinally on a track with at least two wheel sets, the combination comprising:

I) a frame having both a lateral arm providing means for rotatably securing said truck to the body of said railroad car and longitudinal end arms rigidly attached to said lateral arm and extending generally orthogonal thereto;

II) means for suspending said wheel sets from said frame and allowing movement of said wheel sets relative to said frame longitudinally, rotationally in a horizontal plane, and vertically, located between said frame and the location for said wheel sets, said means for suspension suspending each of said wheels for said movement independently of movement of the other wheels of said wheel sets and comprising:

a) a pedestal having one end mounted to the axle of said wheel and an opposite end mounted for pivotal movement to permit said vertical movement of said one end; and b) a hanger mounted between said frame and said pedestal to allow said longitudinal movement; each said pedestal comprising a cylindrical bearing; and c) means for rotatably coupling each said pedestal to said location for said wheel sets; and III) means connecting said body of said railroad car to said means for suspending, for controlling said wheel set movement.

24. In a truck for supporting a railroad car longitudinally on a track with at least two wheel sets, the combination comprising:

I) a frame having both a lateral arm providing means for rotatably securing said truck to the body of said railroad car and longitudinal end arms rigidly attached to said lateral arm and extending generally orthogonal thereto;

II) means for suspending said wheel sets from said frame and allowing movement of said wheel sets relative to said frame longitudinally, rotationally in a horizontal plane, and vertically, located between said frame and the location for said wheel sets; said means for suspension suspending each of said wheels for said movement independently of movement of the other wheels of said wheel sets; and III) means for connecting said body of said railroad car to said means for suspending so as to control said wheel set movement to correspond to the movement of said car body relative to said frame and to align said wheel sets with said track in response to the angular relationship of said car body to said track; said means for connecting comprising:

a) a rotatable member rotatably mounted to said frame, said rotatable member comprising:

i) a shaft rotatably mounted to said frame;
ii) first means for attachment to said shaft at an attachment location medial to ends of shaft at a first distance from the axis of rotation of said member; and
iii) second means for attachment to said shaft at an attachment location proximal to said ends of said shaft at a second distance from said axis of rotation of said member;

b) means for linking coupled between said car body and said rotatable member for rotating said member in response to said angular relationship; and c) means for moving said wheel sets longitudinally relative to said frame, coupled between said rotatable member and said means for suspending; wherein said means for suspension includes for each of said wheels:
i) a pedestal having one end mounted to the axle of said wheel and an opposite end mounted for pivotal movement to permit said vertical movement of said one end; and
ii) a hanger mounted between said frame and said pedestal to allow said longitudinal movement; and
iii) wherein said means for suspension includes for each said wheel, means for rotatably coupling each said pedestal to said location for said wheel sets comprising a cylindrical bearing.

25. In a truck for supporting a railroad car longitudinally on a track with at least two wheel sets, the combination comprising:

I) a frame having both a lateral arm providing means for rotatably securing said truck to the body of said railroad car and longitudinal end arms rigidly attached to said lateral arm and extending generally orthogonal thereto;

II) means for suspending said wheel sets from said frame and allowing movement of said wheel sets relative to said frame longitudinally, rotationally in a horizontal plane, and vertically, located between said frame and the location for said wheel sets; said means for suspension suspending each of the wheels provided by said wheel sets for said movement independently of said movement of the other wheels of said wheels sets; and III) means for connecting said body of said railroad car to said means for suspending so as to control said wheel set movement to correspond to the movement of said car body relative to said frame and to align said wheel sets with said track in response to the angular relationship of said car body to said track; said means for connecting comprising:

a) means for generating an alignment force in response to said angular relationship of said car body to said track; and b) means for distributing said alignment force to said means for suspending for aligning said wheel sets with said track; wherein said means for suspension includes for each of said wheels;
i) a pedestal having one end mounted to the axle of said wheel and an opposite end mounted for pivotal movement to permit said vertical movement of said one end; and
ii) a hanger mounted between said frame and said pedestal to allow said longitudinal movement;

wherein said means for suspension includes for each said wheel, means for rotatably coupling each said pedestal to said location for said wheel sets comprising a cylindrical bearing.

26. In a truck for supporting a railroad car longitudinally on a track with at least two wheel sets, the combination comprising:

I) a frame having both a lateral arm providing means for rotatably securing said truck to the body of said railroad car and longitudinal end arms rigidly attached to said lateral arm and extending generally orthogonal thereto; and II) means between said frame and the location for said wheel sets, for suspending said wheel sets from said frame and allowing movement of said wheel sets relative to said frame longitudinally, rotationally in a horizontal plane, and vertically; said means for suspension suspending each of said wheels provided by said wheel sets for said movement independently of said movement of the other wheels of said wheel sets and for each of said wheels:
i) a pedestal having one end mounted to the axle of said wheel and an opposite end mounted for pivotal movement to permit said vertical movement of said one end; and
ii) a hanger mounted between said frame and said pedestal to allow said longitudinal movement;

said means for suspension including for each said wheel, means for rotatably coupling each said pedestal to said location for said wheel sets; comprising a cylindrical bearing.

27. The truck of claim 26 wherein said means for rotatably coupling each said pedestal comprises an elastomer.

* * * * *